US006625837B2

(12) United States Patent
Jiang

(10) Patent No.: US 6,625,837 B2
(45) Date of Patent: Sep. 30, 2003

(54) CLEANING BRUSH STRUCTURE

(76) Inventor: Zhen-Yuan Jiang, 58, Ma Yuan West St., Taichung (TW)

( * ) Notice: Subject to any disclaimer, the term of this patent is extended or adjusted under 35 U.S.C. 154(b) by 270 days.

(21) Appl. No.: 09/901,182

(22) Filed: Jul. 6, 2001

(65) Prior Publication Data

US 2002/0078518 A1 Jun. 27, 2002

(30) Foreign Application Priority Data

Dec. 27, 2000 (TW) ..... 89222707 U

(51) Int. Cl.[7] ..... A47L 13/00; A47L 13/12

(52) U.S. Cl. ..... 15/105; 15/111; 15/114; 15/172

(58) Field of Search ..... 15/105, 106, 111, 15/114, 117, 121, 144.1, 172, 236.01, 236.02, 245

(56) References Cited

U.S. PATENT DOCUMENTS 2,680,032 A * 6/1954 McClenahan ..... 403/97
5,960,509 A * 10/1999 Wu ..... 15/244.2
6,152,635 A * 11/2000 Wu ..... 401/270
6,481,041 B1 * 11/2002 Ingram ..... 15/111

* cited by examiner

*Primary Examiner*—Terrrence R. Till

(57) ABSTRACT

The present invention relates to a cleaning brush structure including an operation rod, a snow shovel, an angle adjuster, and a cleaning body. The angle adjuster includes a socket, two operation rings, a main base, two compression springs, and two press members. The angle adjuster can be used to adjust the usage angle of the operation rod. The cleaning body includes an elongated plate, a glass scraper, and a brush. The elongated plate has a first side formed with a scraper clipping groove for securing the glass scraper and a second side formed with a brush clipping groove for securing the brush.

1 Claim, 8 Drawing Sheets

CLEANING BRUSH STRUCTURE

BACKGROUND OF THE INVENTION

1. Field of the Invention

The present invention relates to a cleaning brush structure, and more particularly to a cleaning brush structure which may arbitrarily adjust the included angle between the operation rod and the cleaning body by an angle adjuster.

2. Description of the Related Art

A conventional cleaning tool in accordance with the prior art comprises a cleaning body, and a handle pivoted on the cleaning body by a driving unit. When the cleaning body is connected with the handle, the driving unit may provide a positioning effect. However, the included angle between the cleaning body and the handle cannot be adjusted arbitrarily, thereby easily causing inconvenience to the user, and greatly limiting the versatility of the cleaning tool.

SUMMARY OF THE INVENTION

The present invention has arisen to mitigate and/or obviate the disadvantage of the conventional cleaning body.

The primary objective of the present invention is to provide a cleaning brush structure which includes an angle adjuster that may arbitrarily adjust the included angle between the operation rod and the cleaning body.

Another objective of the present invention is to provide a cleaning brush structure, wherein the operation rod may be positioned on the cleaning body rigidly and stably.

In accordance with the present invention, there is provided a cleaning brush structure comprising: an operation rod, a snow shovel, an angle adjuster, and a cleaning body; the operation rod including an inner rod, an outer rod telescopically mounted on the inner rod, and a handgrip portion made of soft rubber material mounted on the outer rod; the snow shovel including a blade integrally formed with a sleeve, the sleeve secured on an upper end of the outer rod of the operation rod; wherein, the angle adjuster includes a socket, two operation rings, a main base, two compression springs, and two press members;

the socket has an upper end secured on a lower end of the inner rod, and a lower end formed with two spaced downward extended plates, a gap is defined between inner walls of the two downward extended plates, a center of the inner wall of each downward extended plate is formed with an annular insertion groove, a center of each downward extended plate is formed with a transverse through hole, the through hole has a peripheral wall formed with a plurality of tooth insertion splines which are equally spaced from each other;

each operation ring is a T-shaped ring that is inserted into the annular insertion groove and the through hole of the respective downward extended plate, an outer wall of a small diameter of each operation ring is protruded with a plurality of locking teeth which are equally spaced from each other, each of the locking teeth has an inner section which may be inserted into the tooth insertion spline of the downward extended plate, a center of each operation ring is formed with a member passing hole which has a first end formed with a locking recess and a second end formed with a member receiving recess;

the main base includes a bottom plate integrally formed with two spaced upward extended plates, the arcuate bottom plate has four corners each formed with a member passing hole for passage of a rivet member, each upward extended plate has an inner wall formed with an annular insertion groove and an outer wall formed with a member receiving recess, the annular insertion groove has a peripheral wall formed with a plurality of tooth insertion splines which are equally spaced from each other, each of the locking teeth of the operation ring has an outer section which may be inserted into the tooth insertion spline of the annular insertion groove, a member passing hole is formed between the annular insertion groove and the member receiving recess;

each compression spring is received in the member receiving recess of the respective upward extended plate;

each press member is a T-shape member that includes an outer ring integrally formed with a pivot section, the outer ring is formed with an annular recess for securing the compression spring, the pivot section has a distal end formed with an annular groove and an inclined guide face;

the cleaning body includes an elongated plate, a glass scraper, and a brush, the elongated plate has a first side formed with a scraper clipping groove and a second side formed with a brush clipping groove, and has a mediate section formed with four member passing holes for passage of the rivet members, the glass scraper is a plate formed by soft plastic material, and has an inner edge secured in the scraper clipping groove of the elongated plate, the brush consists of multiple plastic threads, and has an inner edge secured in the brush clipping groove of the elongated plate.

Further benefits and advantages of the present invention will become apparent after a careful reading of the detailed description with appropriate reference to the accompanying drawings.

DETAILED DESCRIPTION OF THE INVENTION

Figure 1:
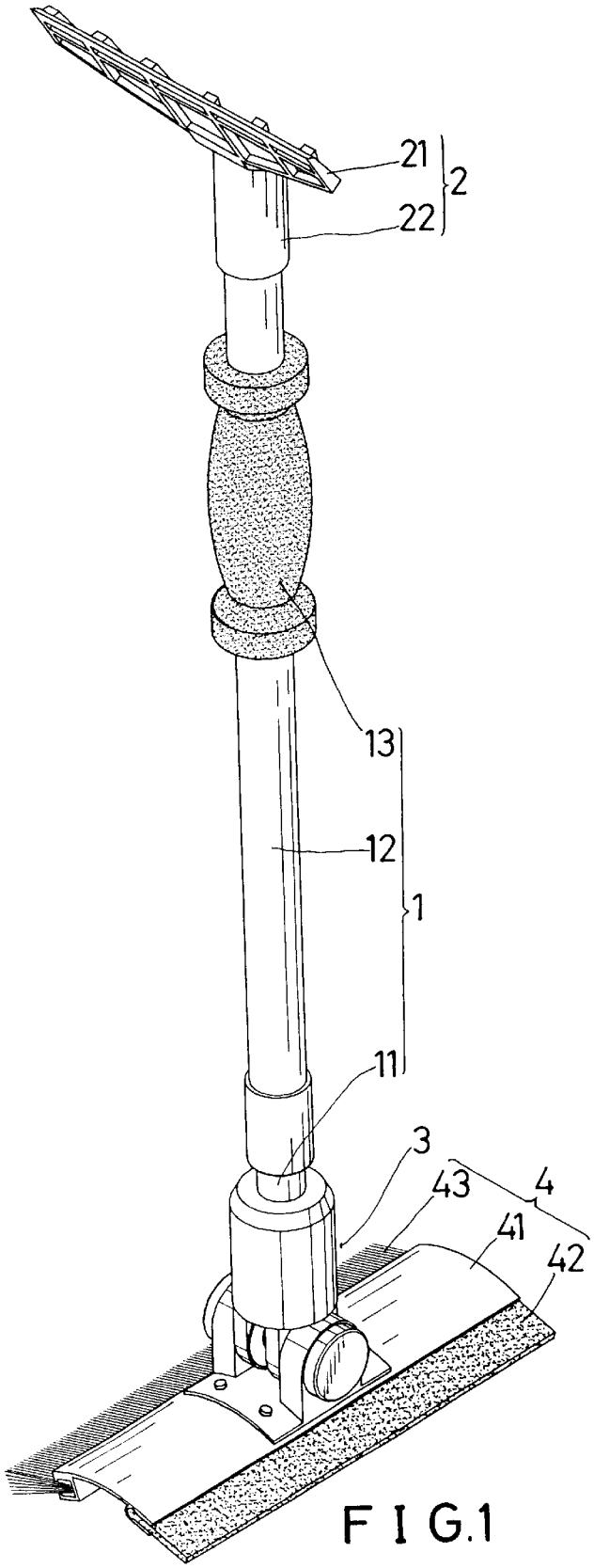
FIG. 1 is a perspective view of a cleaning brush structure in accordance with the present invention.
Figure 2:
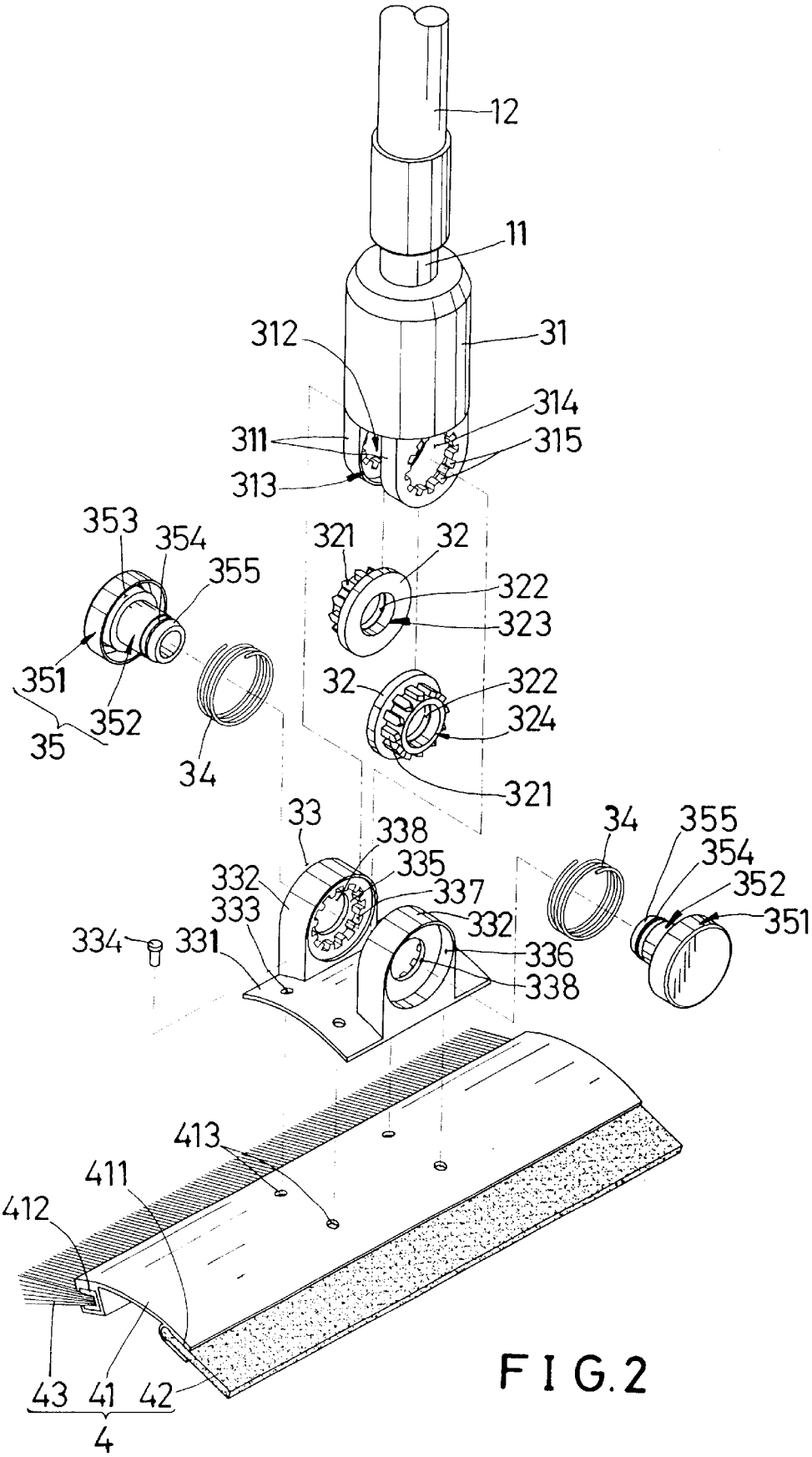
FIG. 2 is an exploded perspective view of an angle adjuster of the cleaning brush structure in accordance with the present invention.

Referring to the drawings and initially to FIGS. 1 and 2, a cleaning brush structure in accordance with the present invention primarily comprises an operation rod 1, a snow shovel 2, an angle adjuster 3, and a cleaning body 4.

The operation rod 1 includes an inner rod 11, an outer rod 12 telescopically mounted on the inner rod 11, and a handgrip portion 13 made of soft rubber material mounted on the outer rod 12.

The snow shovel 2 includes a blade 21 integrally formed with a sleeve 22. The sleeve 22 is secured on the upper end of the outer rod 12 of the operation rod 1.

The angle adjuster 3 includes a socket 31, two operation rings 32, a main base 33, two compression springs 34, and two press members 35.

The socket 31 has an upper end secured on the lower end of the inner rod 11, and a lower end formed with two spaced downward extended plates 311. A gap 312 is defined between the inner walls of the two downward extended plates 311. The center of the inner wall of each downward extended plate 311 is formed with an annular insertion groove 313. The center of each downward extended plate 311 is formed with a transverse through hole 314. The through hole 314 has a peripheral wall formed with a plurality of tooth insertion splines 315 which are equally spaced from each other.

Each operation ring 32 is a T-shaped ring that is inserted into the annular insertion groove 313 and the through hole 314 of the respective downward extended plate 311. The outer wall of the small diameter of each operation ring 32 is protruded with a plurality of locking teeth 321 which are equally spaced from each other. Each of the locking teeth 321 has an inner section which may be inserted into the tooth insertion spline 315 of the downward extended plate 311. The center of each operation ring 32 is formed with a member passing hole 322 which has a first end formed with a locking recess 323 and a second end formed with a member receiving recess 324.

The main base 33 includes a bottom plate 331 integrally formed with two spaced upward extended plates 332. The arcuate bottom plate 331 has four corners each formed with a member passing hole 333 for passage of a rivet member 334. Each upward extended plate 332 has an inner wall formed with an annular insertion groove 335 and an outer wall formed with a member receiving recess 336. The annular insertion groove 335 has a peripheral wall formed with a plurality of tooth insertion splines 337 which are equally spaced from each other. Each of the locking teeth 321 of the operation ring 32 has an outer section which may be inserted into the tooth insertion spline 337 of the annular insertion groove 335. A member passing hole 338 is formed between the annular insertion groove 335 and the member receiving recess 336.

Each compression spring 34 is received in the member receiving recess 336 of the respective upward extended plate 332.

Each press member 35 is a T-shape member that includes an outer ring 351 integrally formed with a pivot section 352. The outer ring 351 is formed with an annular recess 353 for securing the compression spring 34. The pivot section 352 has a distal end formed with an annular groove 354 and an inclined guide face 355.

The cleaning body 4 includes an elongated plate 41, a glass scraper 42, and a brush 43. The elongated plate 41 has a first side formed with a scraper clipping groove 411 and a second side formed with a brush clipping groove 412, and has a mediate section formed with four member passing holes 413 for passage of the rivet members 334. The glass scraper 42 is a plate formed by soft plastic material, and has an inner edge secured in the scraper clipping groove 411 of the elongated plate 41. The brush 43 consists of multiple plastic threads, and has an inner edge secured in the brush clipping groove 412 of the elongated plate 41.

Figure 3:
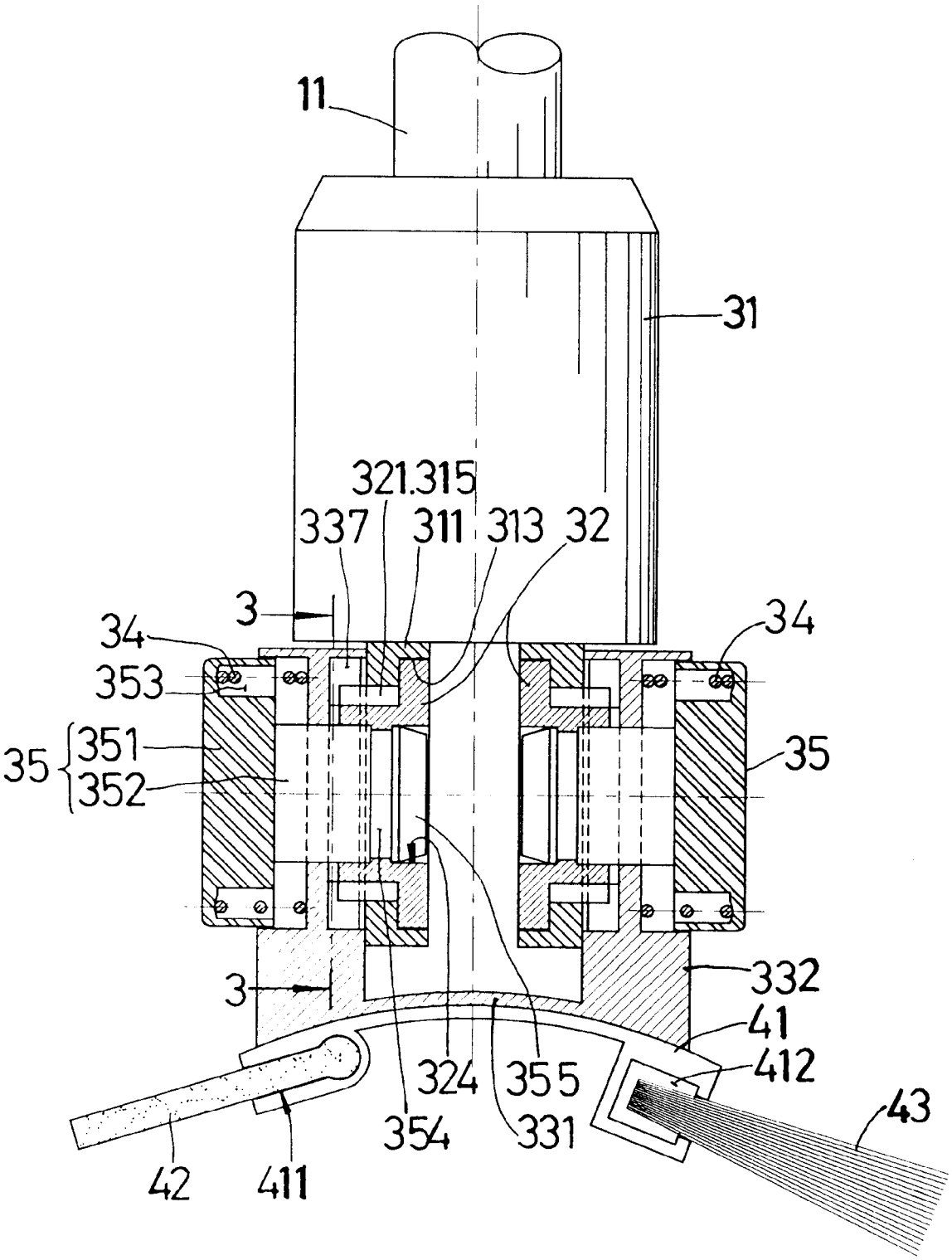
FIG. 3 is a cross-sectional assembly view of the angle adjuster of the cleaning brush structure as shown in FIG. 2.
Figure 3A:
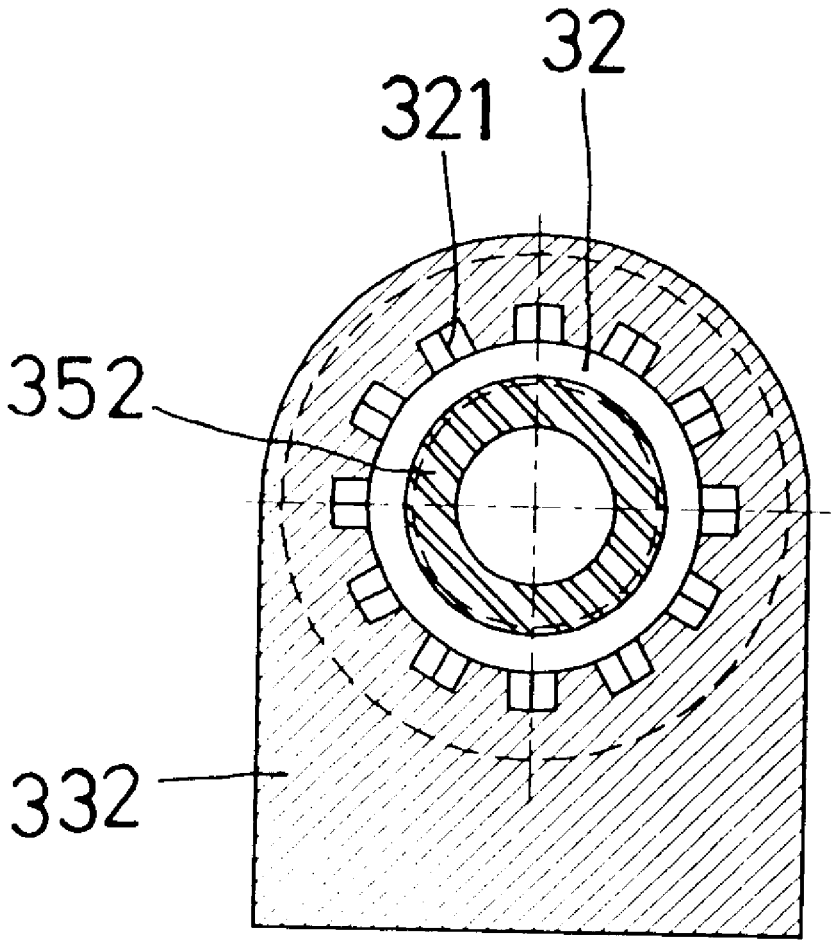
FIG. 3A is a cross-sectional view of the angle adjuster of the cleaning brush structure along line 3—3 as shown in FIG. 3.
Figure 4:
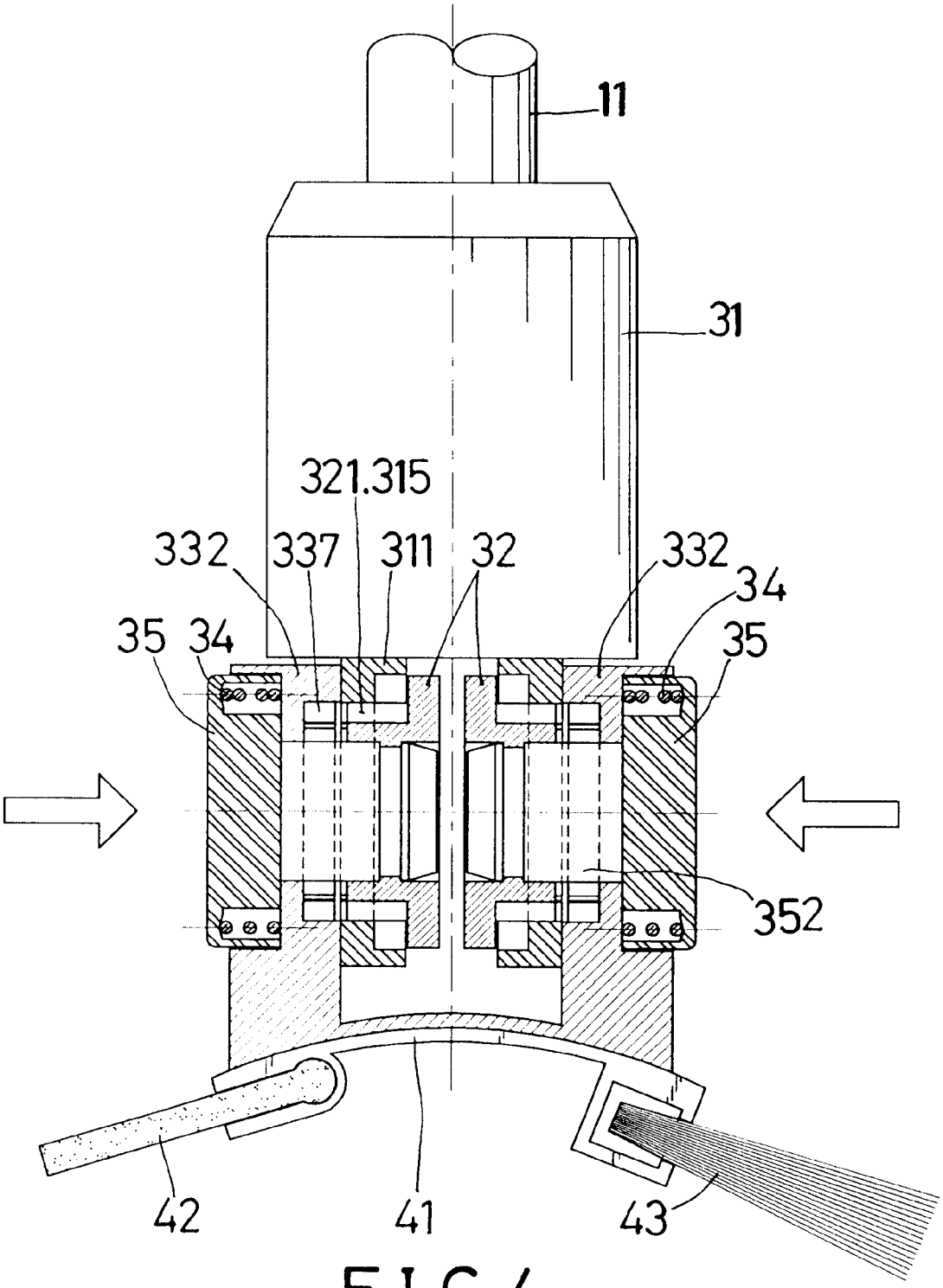
FIG. 4 is a schematic operational view of the angle adjuster of the cleaning brush structure as shown in FIG. 3 in use.

In assembly, referring to FIGS. 3 and 4, each operation ring 32 is inserted into the annular insertion groove 313 and the through hole 314 of the respective downward extended plate 311, so that the inner section of each of the locking teeth 321 may be inserted into the tooth insertion spline 315 of the through hole 314 of the downward extended plate 311.

Then, the two downward extended plates 311 are placed between the two upward extended plates 332, and the through hole 314 of each downward extended plate 311 is co-axial with the member passing hole 338 of the upward extended plate 332. Each compression spring 34 is then placed in the member receiving recess 336 of the respective upward extended plate 332.

Then, the pivot section 352 of each press member 35 in turn extends through the compression spring 34, through the member passing hole 338 of the upward extended plate 332, and through the through hole 314 of the downward extended plate 311. The distal end of the pivot section 352 of each press member 35 is then secured in the locking recess 323 of the operation ring 32, so that the press member 35 may be integrally combined with the operation ring 32.

The socket 31 is then secured on the lower end of the inner rod 11 of the operation rod 1. Each rivet member 334 is then extended through the member passing hole 333 of the bottom plate 331 of the main base 33, and is riveted in the member passing hole 413 of the elongated plate 41, so that the angle adjuster 3 is combined with the cleaning body 4. The sleeve 22 of the snow shovel 2 may be secured on the upper end of the outer rod 12 of the operation rod 1, thereby completing assembly of the cleaning brush structure in accordance with the present invention.

Figure 5:
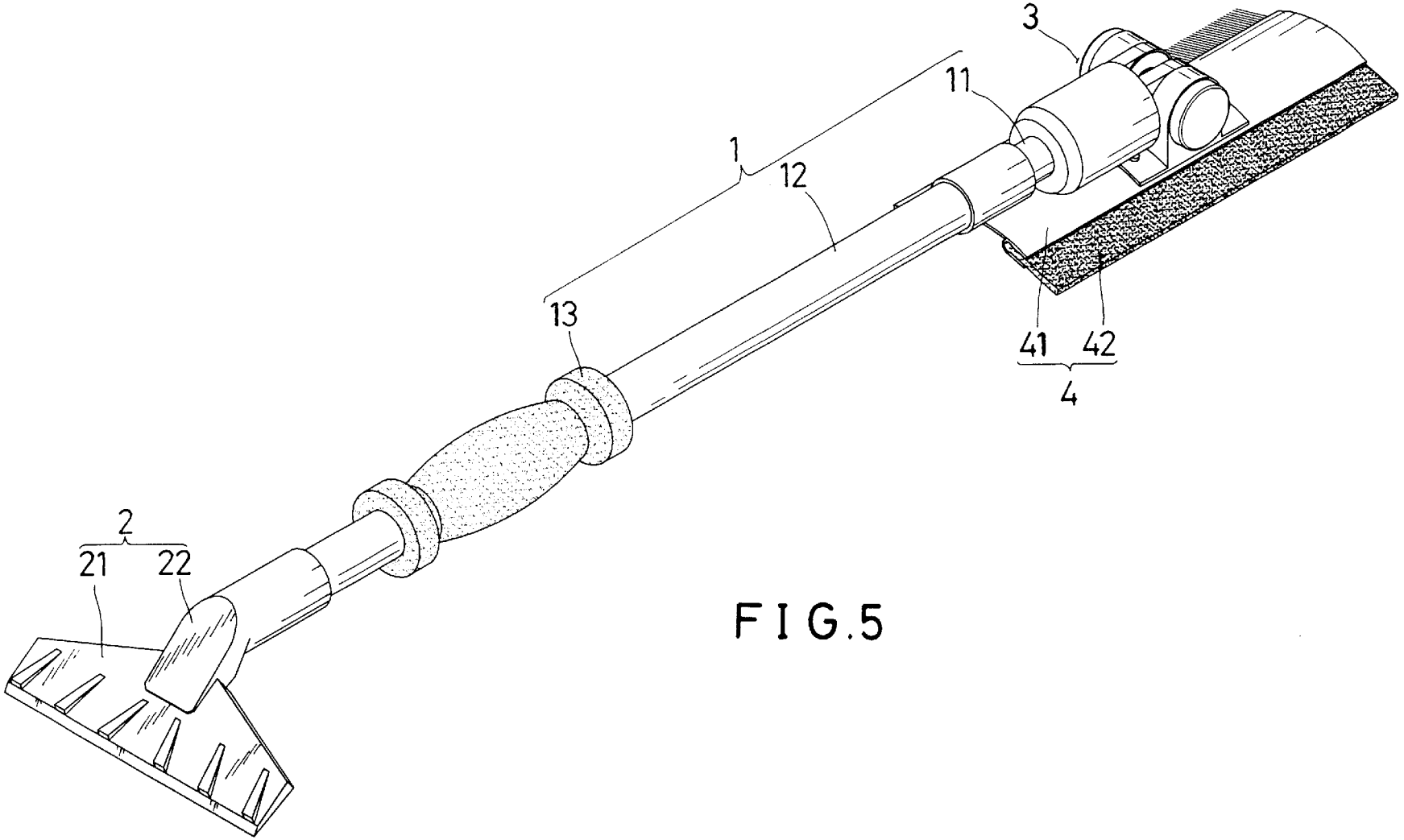
FIG. 5 is a schematic operational view of the cleaning brush structure as shown in FIG. 1 in use.
Figure 6:
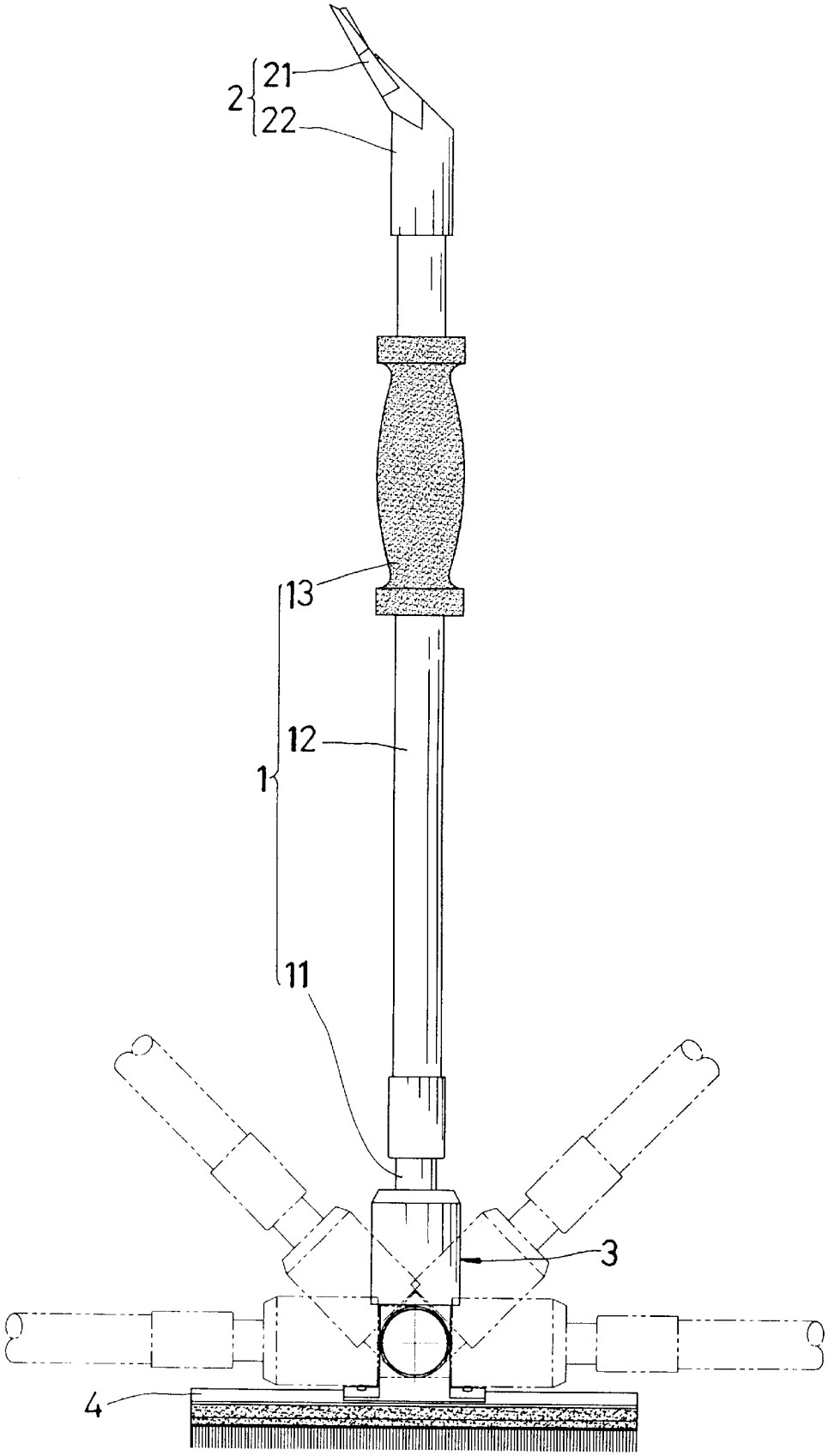
FIG. 6 is a side plan operational view of the cleaning brush structure as shown in FIG. 1.

In operation, referring to FIGS. 4–6, each press member 35 may be pressed inward to push each operation ring 32 inward, thereby detaching the locking teeth 321 of the operation ring 32 from the tooth insertion splines 337 of the annular insertion groove 335 of the respective upward extended plate 332, so that the socket 31 together with the two downward extended plates 311 may be pivoted about the pivot section 352 of the press member 35, thereby adjusting the angle of the operation rod 1. When the angle of the operation rod 1 is reached, the press force on each press member 35 may be removed, so that each press member 35 may be returned to its original position by the restoring force of the compression spring 34, to move each operation ring 32 outward, so that the locking teeth 321 of the operation ring 32 again engage the tooth insertion splines 337 of the annular insertion groove 335 of the respective upward extended plate 332, thereby positioning the operation rod 1 on the cleaning body 4.

Figure 7:
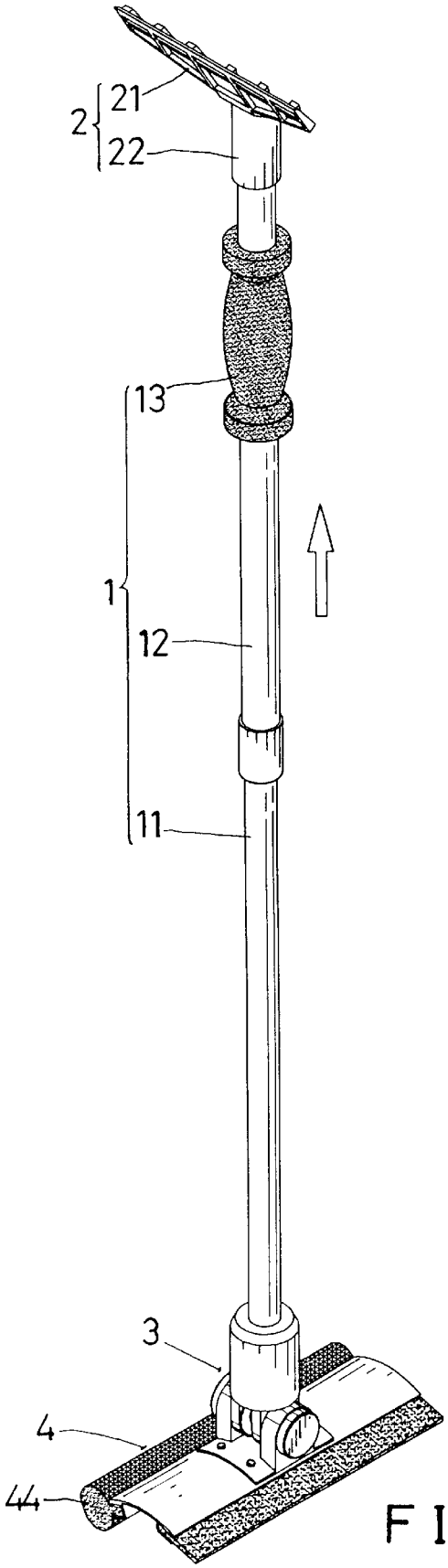
FIG. 7 is a perspective view of the cleaning brush structure in accordance with another embodiment of the present invention.

Referring to FIG. 7, a sponge brush 44 has an inner edge secured in the brush clipping groove 412 of the elongated plate 41.

Accordingly, the cleaning brush structure in accordance with the present invention has the following advantages.

1. The angle of the operation rod 1 can be arbitrarily adjusted by the angle adjuster 3.

2. The cleaning body 4 includes an elongated plate 41 secured with a glass scraper 42 and a brush 43, thereby greatly enhancing the versatility of the cleaning body 4.

3. The cleaning brush structure in accordance with the present invention has a simplified construction.

4. The cleaning brush structure in accordance with the present invention has an excellent positioning effect by the angle adjuster.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A cleaning brush structure comprising:

an operation rod, a snow shovel, an angle adjuster, and a cleaning body;

the operation rod including an inner rod, an outer rod telescopically mounted on the inner rod, and a hand-grip portion made of soft rubber material mounted on the outer rod;

the snow shovel including a blade integrally formed with a sleeve, the sleeve secured on an upper end of the outer rod of the operation rod; wherein, the angle adjuster includes a socket, two operation rings, a main base, two compression springs, and two press members;

the socket has an upper end secured on a lower end of the inner rod, and a lower end formed with two spaced downward extended plates, a gap is defined between inner walls of the two downward extended plates, a center of the inner wall of each downward extended plate is formed with an annular insertion groove, a center of each downward extended plate is formed with a transverse through hole, the through hole has a peripheral wall formed with a plurality of tooth insertion splines which are equally spaced from each other;

each operation ring is a T-shaped ring that is inserted into the annular insertion groove and the through hole of the respective downward extended plate, an outer wall of a small diameter of each operation ring is protruded with a plurality of locking teeth which are equally spaced from each other, each of the locking teeth has an inner section which may be inserted into the tooth insertion spline of the downward extended plate, a center of each operation ring is formed with a member passing hole which has a first end formed with a locking recess and a second end formed with a member receiving recess;

the main base includes a bottom plate integrally formed with two spaced upward extended plates, the arcuate bottom plate has four corners each formed with a member passing hole for passage of a rivet member, each upward extended plate has an inner wall formed with an annular insertion groove and an outer wall formed with a member receiving recess, the annular insertion groove has a peripheral wall formed with a plurality of tooth insertion splines which are equally spaced from each other, each of the locking teeth of the operation ring has an outer section which may be inserted into the tooth insertion spline of the annular insertion groove, a member passing hole is formed between the annular insertion groove and the member receiving recess;

each compression spring is received in the member receiving recess of the respective upward extended plate;

each press member is a T-shape member that includes an outer ring integrally formed with a pivot section, the outer ring is formed with an annular recess for securing the compression spring, the pivot section has a distal end formed with an annular groove and an inclined guide face;

the cleaning body includes an elongated plate, a glass scraper, and a brush, the elongated plate has a first side formed with a scraper clipping groove and a second side formed with a brush clipping groove, and has a mediate section formed with four member passing holes for passage of the rivet members, the glass scraper is a plate formed by soft plastic material, and has an inner edge secured in the scraper clipping groove of the elongated plate, the brush consists of multiple plastic threads, and has an inner edge secured in the brush clipping groove of the elongated plate.

* * * * *